United States Patent [19]

Scalisi et al.

[11] Patent Number: 4,813,744

[45] Date of Patent: Mar. 21, 1989

[54] COLLAPSIBLE DISPOSABLE CHAIR

[76] Inventors: Phillip M. Scalisi, 5871 Furnace Creek Rd., Yorba Linda, Calif. 92686; Joseph F. Scalisi, 808 N. Lorri Way, Walnut, Calif. 91789

[21] Appl. No.: 223,513

[22] Filed: Jul. 22, 1988

[51] Int. Cl.[4] ..... A47C 7/00

[52] U.S. Cl. ..... 297/440; 297/442; 297/457

[58] Field of Search ..... 297/440, 442, 457

[56] References Cited

U.S. PATENT DOCUMENTS 2,012,117 9/1935 Barron .
2,361,875 10/1944 Sachs .
2,822,860 2/1958 Calabrese .
3,220,362 11/1965 Downes .
3,714,908 2/1973 Notko .
4,085,970 4/1978 Klein .
4,556,253 12/1985 Geneve et al. .
4,648,658 3/1987 Calco .

*Primary Examiner*—Francis K. Zugel
*Attorney, Agent, or Firm*—Knobbe, Martens, Olson & Bear

[57] ABSTRACT

A disposable collapsible chair is formed by joining opposing ends of a sheet of material to form a continuous loop, forming four panels, each of which is a side of the chair. Several portions of the bottom part of the panels fold inside of the continuous loop to define legs of the chair. A front panel folds onto the top of the legs to form a seat. Side panels form the arm rests, and a back panel forms a back rest. Additional portions may be added to each of the four panels to form strengthening portions which fold at intermediate lines to strengthen portions of the arm rests, the seat, or the back rest. The various panels and fold lines may be preformed and cut from a substantially rectangular sheet.

32 Claims, 7 Drawing Sheets

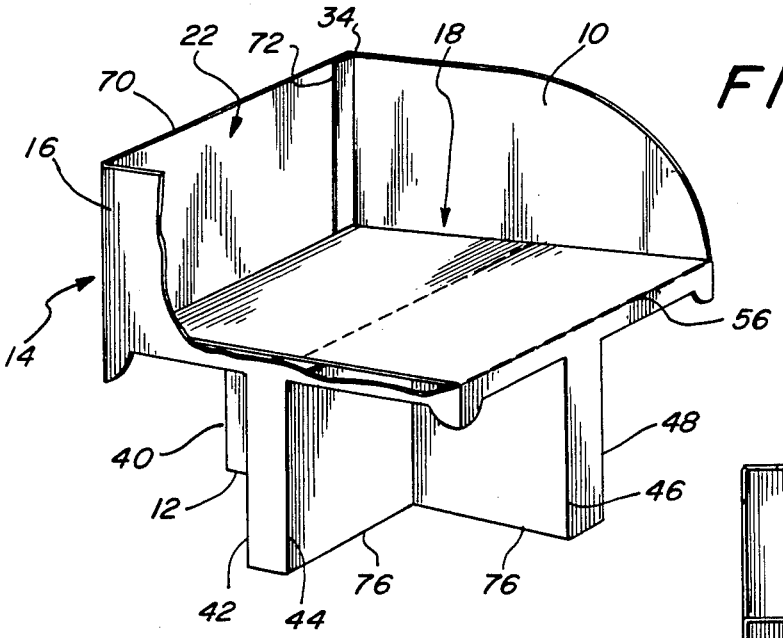
FIG. 4
FIG. 5
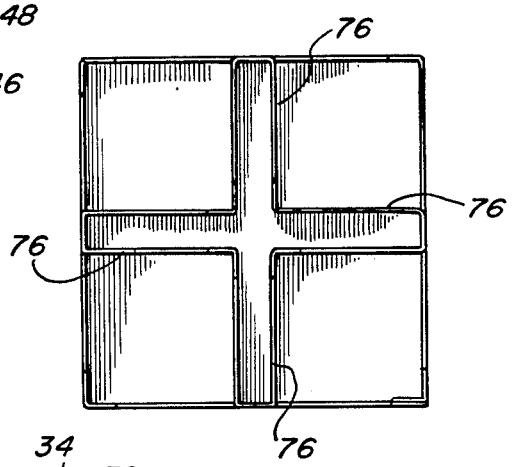
FIG. 6
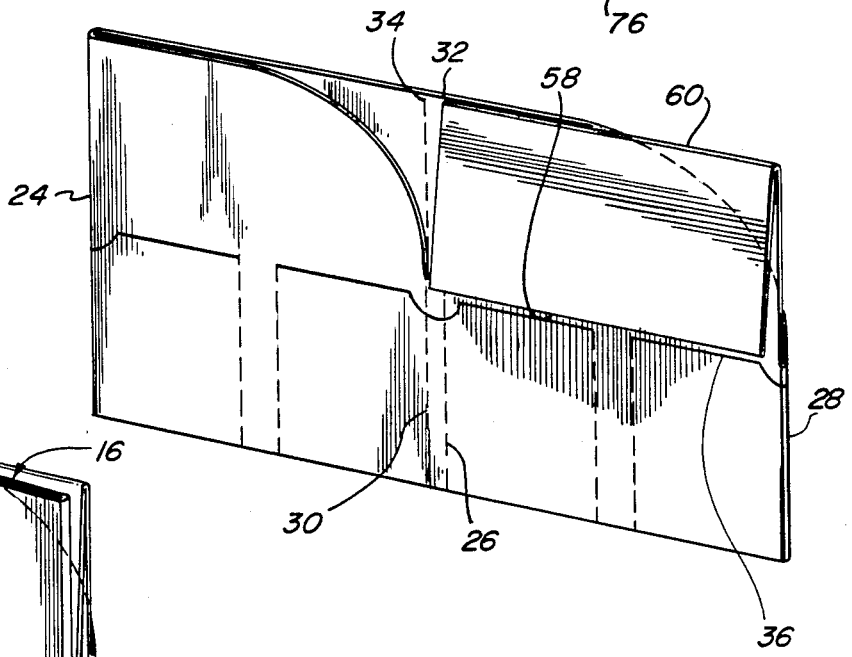
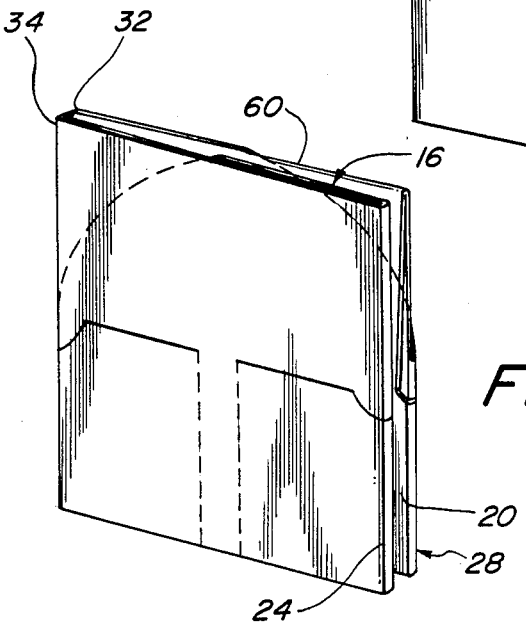
FIG. 7

118
154
116
173
175
168
120
178
186
122
212
200
193
206
205
195
158
204
162
203
170
190
183
197
191
192
157
156
214
182
200
171
152
146
196
150
148
112
130
132
124
134
136
126
138
140
128
142
144
194
112

212
195
190
191
168
175
192
214
205
174
212
206
176
193
171
112

COLLAPSIBLE DISPOSABLE CHAIR

FIELD OF THE INVENTION

This invention relates to the construction of chairs from cardboard or other fiber board and the like and, more particularly, relates to a collapsible seat which can be transformed from a generally flat or folded state into an expanded or setup form whereby it is usable as a chair.

BACKGROUND OF THE INVENTION

Many persons attend events for which it would be desirable to have a portable chair. Such events would include visits to the beach or sporting events. Many people consider it too cumbersome to carry a portable chair from their home to these events. Thus, there is a need for a chair which is sufficiently lightweight and portable that people would take it to such events.

Even if a lightweight and portable chair exists, many people do not wish to be bothered by the extra effort to carry the chair away after the event terminates. Thus, there is a need to provide a foldable chair so constructed that its manufacture and cost is sufficiently low that it can be discarded or otherwise disposed of after one or a few uses.

There are a number of portable stools or seats available on the market, but few chairs. The portable seats typically lack arm rests and/or back rests. There is thus a need for a portable chair having an arm rest and a back rest.

It is also desirable to keep the cost of the chairs as low as possible, not only by reducing the manufacturing costs but by finding ways to subsidize the cost of the chairs. There is thus a need for a chair which lends itself to having its cost subsidized by others.

The foregoing and other objects will appear as the nature of the invention is better understood by reference to the drawings. The nature of this invention is such as to render it susceptible to various changes and modifications, and therefore, we do not intend to be limited to the particular construction disclosed by the drawings nor the particular parts described in the specification, but are entitled to all such changes therefrom as fall within the scope of the claims.

SUMMARY OF THE INVENTION

A chair having four intersecting legs is formed from a single sheet of material. The chair preferably has a back, and arm rests. Various embodiments provide differing amounts of support to the seat, arm rests, and back. The chair can be changed from the chair configuration into a substantially flat, square packaged configuration, and vice versa, by folding portions of the chair about predefined fold lines.

In the first embodiment, the chair is assembled from a sheet of material. That sheet of material has a predetermined thickness, a substantially straight bottom edge, an outermost top edge opposite thereto, and two free ends joining the bottom and outermost top edges. The sheet further has four panels defined by prescored corner fold lines to form a front, back, left, and right panel. A pair of substantially parallel center fold lines are located at about the center of each of the four panels, extending from the bottom edge toward the outermost top edge, being oriented substantially perpendicular to the bottom edge, and terminating at an end point. An intermittent cut line extends through the thickness of the sheet of material. The cut line is spaced apart from, but runs along the length of the bottom edge. The cut line extends from the end point of one center fold line on one panel to the end point of the nearest center fold line on the adjacent panel, and also extends from the end point of the fold lines adjacent the free ends of the sheet of material, toward the adjacent free end, so as to leave the space between each pair of center fold lines substantially uncut.

On at least one of the panels, there is at least one, first seat fold line, substantially parallel to the bottom edge, located between the intermittent cut line and the outermost top edge, and extending across the panel. The portion of the panel located between the seat fold line and the outermost top edge defines a seat area. A connecting area is located along one of the free edges, and is shaped to interact with a corresponding area on the opposite free edge. This allows the opposing edges of the sheet of material to be joined into a continuous loop.

In an alternative embodiment, the sheet further has a second fold line located between the seat fold line and the outermost top edge, the outermost top edge of each of the remaining panels corresponding to the height at which the second fold line is located. The second fold line allowing the seat portion to be folded into a configuration one dimension of which corresponds to the distance between the bottom edge and the outermost top edges of the panels.

In a still further embodiment, the sheet material has a first and second right panel fold line located between the cut line and the outer edge of the right panel, with the first right panel fold line being close to the cut line, but spaced from the cut line at a distance corresponding to the height of the arms of a chair. The first and second fold lines on the right panel are substantially parallel to the cut line, and extend across the right panel. The portion between the first and second fold lines of the right panel defines a right side portion, and the portion between the second fold line and the outer edge of the right panel defines a right seat portion.

The alternative embodiment further comprises a first and second left panel fold line located between the cut line and the outer edge of the left panel, with the first left panel fold line being close to the cut line, but spaced from the cut line at a distance corresponding to the height of the arms of a chair. The first and second fold lines on the left panel are substantially parallel to the cut line, and extend across the left panel. The portion between the first and second fold lines of the left panel define a left side portion, and the portion between the second fold line and the outer edge of the left panel define a left seat portion.

Finally, the alternative embodiment of the sheet material comprises a first and second front panel fold line located between the seat fold line and the outer edge of the front panel, with the first front panel fold line being closest to the seat fold line, but spaced from the seat fold line at distance approximating the depth of the seat for a chair formed from the blank of sheet material. The first and second fold lines on the right panel are substantially parallel to the seat fold line, and extend across the right panel. The portion between the first and second fold lines of the front panel defines a back rest portion, and the portion between the second fold line and the outer edge of the front panel defines a back brace portion.

In yet another embodiment of this invention, the sheet of material further comprises a first back panel fold line located between the cut line and the outer edge of the back panel. The first back panel fold line is substantially parallel to the cut line, and extends across the back panel. The portion between the first fold line of the back panel and the outer edge defines a back brace portion.

In a further embodiment of the above, a tab is placed on the outer edge of the pack panel. A slot is placed in the first front panel fold line, positioned such that the tab can be inserted into the slot when the sheet of material is assembled into a chair, with the tab locking the back brace portion into position with respect to the front panel seat portion.

In each of the above embodiments, the sheet material, or blank, may have a portion of the left and right panels shaped to form arm rests of a chair when the blank of material is assembled into a chair.

In the above embodiments, it is advantageous to have the cut line curve toward the bottom edge adjacent each of the corner fold lines, to form a curved tab around a portion of the intersection of two fold lines in order to inhibit tearing during assembly and use of the chair.

The scored, cut and perforated sheet material may be assembled into a chair, preferably having four legs, a back and arm rests. In this configuration, opposing ends of a flat sheet of material are joined to form a continuous loop of material having a bottom edge. The continuous loop of material is positionable in a first, substantially flat packaged configuration, and positionable in a second, substantially square, box-like chair configuration. The material has a plurality of fold lines generally perpendicular to the bottom edge. The fold lines have an interior end opposite the bottom edge, with an intermittent cut line joining plurality of the fold lines. The cut line enables a plurality of the fold lines to be repositioned inside of the continuous loop to define a plurality of legs having a bottom for resting against the ground, and a top, when the continuous loop of material is in the second, chair configuration. The sheet material also contains a seat portion which can be positioned to rest against the top of the legs to form a seat when the continuous loop of material is in the second, chair position. Further, there can be side portions on the sheet of material which form arm rests when the continuous loop of material is in the second, chair position. Finally, there is a back portion, connecting the side portions, and forming a back rest when the continuous loop of material is in the second, chair position.

In a further embodiment, the seat portion further comprises a back rest connected to the seat portion along an intermediate fold line, so the back rest can brace against the back portion when the continuous loop of material is in the second, chair position.

In a still further embodiment of the chair, each of the side portions further comprise a side support portion connected to said side portions along an intermediate fold line, with the side support portion being positioned adjacent to the side portion to strengthen the arm rests formed when the continuous loop of material is in the second, chair position. A further variation on this latter embodiment adds to at least one of the side portions a seat support portion connected to the side support portion along an intermediate fold line, with the seat support portion being positionable adjacent the top of the legs when the loop of material is in the second, chair position.

The back portion of the chair can be further modified by adding a second back rest portion connected to the second back portion along an intermediate fold line, the back rest position being positionable on the inside of the continuous loop overlaying the first back rest portion when the continuous loop of material is in the second, chair position.

A locking tab may be added to the chair by placing a tab on an outermost edge of the second back rest portion, and placing an aperture on the seat portion into which the tab may be removeably inserted to retain the second back rest portion in position when the continuous loop of material is in the second, chair position.

The above described chair, and the various embodiments thereon, may be packaged into a small configuration by first folding the continuous loop of material into a planar configuration along predefined fold lines, preferably located at opposing corners of the chair. Additional fold lines allow any bracing or strengthening portions of the various front, back or side panels to be folded into a substantially flat, rectangular configuration having a height of about the height of the chair in the assembled configuration. A final fold at the middle of the rectangle allows the chair to be folded in to a substantially square, flat configuration for shipping.

BRIEF DESCRIPTION OF THE DRAWINGS

The invention may take physical form in certain parts and arrangements of parts, preferred embodiments of which will be described in detail in this specification and illustrated in the accompanying drawings in which like numbers like parts, and wherein:

FIG. 4 is a partial perspective view of the chair assembled from the blank of FIG. 1;

FIG. 5 is a bottom plan view of the chair shown in FIG. 4;

FIG. 6 is a perspective view of a partially folded chair of this invention;

FIG. 7 is a perspective view of a folded chair of this invention;

DESCRIPTION OF THE PREFERRED EMBODIMENT

Three main alternative embodiments will be described, beginning with the embodiment having the simplest construction, and proceeding to the embodiment with the more complex construction and reinforcement.

Figure 1:
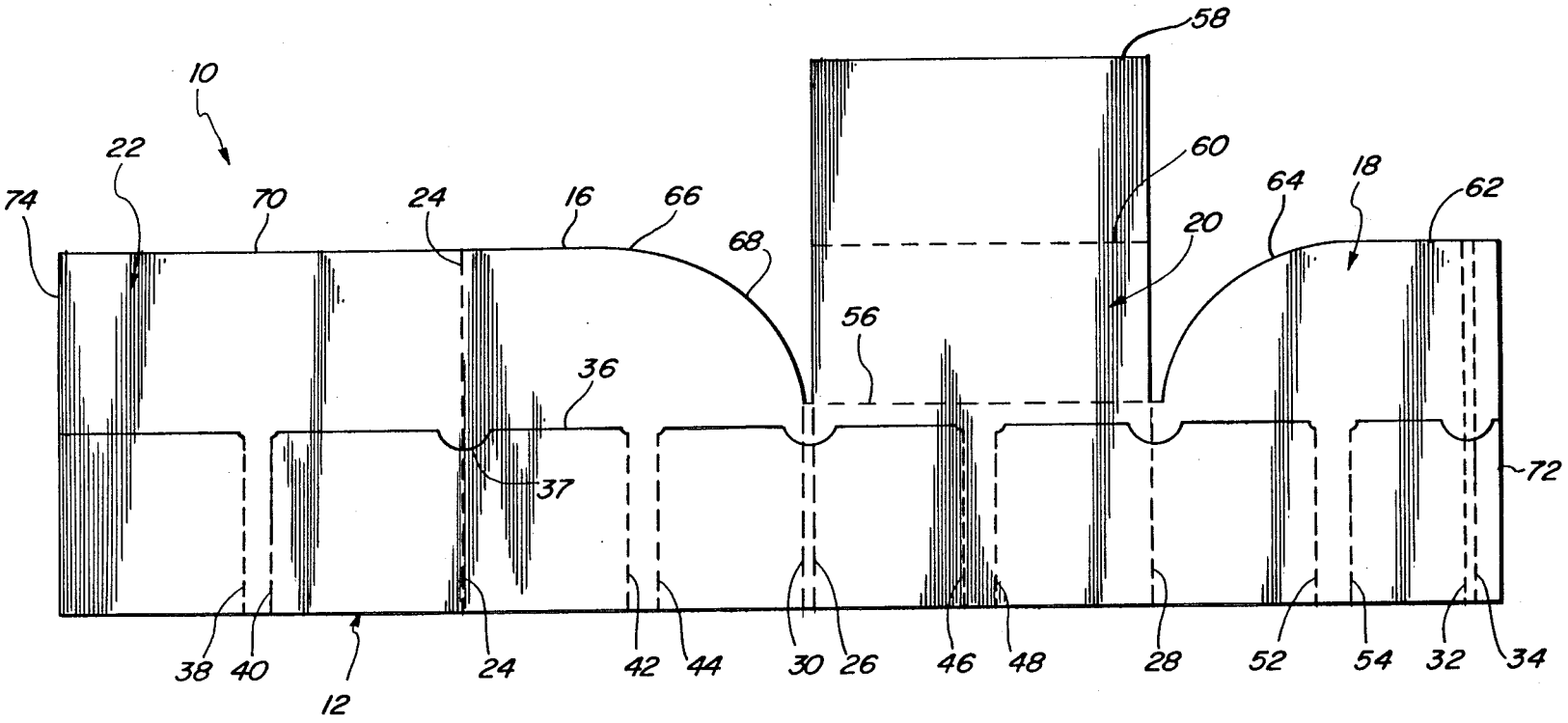
FIG. 1 is a top plan view of a blank of sheet material from which a chair of a first preferred embodiment of this invention can be assembled.

FIG. 1 shows a cut, scored and perforated sheet of material such as double wall, 350 pound cardboard which is preferably cut from the integral sheet. If cardboard is used, it can advantageously be made from a waterproof or water resistant material help resist the effects of moisture. It is also believed possible to use fiberboard or plastic or the like instead of cardboard, although waterproof cardboard being preferred.

The integral blank of sheet material 10 has a substantially straight edge 12 which will form the bottom of the chair 14 (FIG. 4) when assembled. As used herein, the reference to a "bottom" edge will refer to that portion of the material which, when assembled to form a chair, rests against the ground.

The sheet material 10 is divided into four panels of approximately equal width when measured along the bottom edge 12. Right and left panels 16, 18, respectively, form the right and left sides of the assembled chair 14 (FIG. 4) when viewed from the position of a person sitting in the assembled chair 14 (FIG. 4). The front and back panels 20, 22, respectively, form the front and back portions of the assembled chair 14 (FIG. 4).

The panels 16, 18, 20, 22 are formed by scoring the sheet material 10 at fold lines 24, 26, 28. Fold line 24 is substantially perpendicular to the bottom edge 12 and is located between back panel 22 and right side panel 16. Fold line 26 is substantially perpendicular to the bottom edge 12, and is located between right panel 16 and front panel 20. Fold line 28 is substantially perpendicular to the bottom edge 12 and is located between the front panel 20 and the left side panel 18. The fold lines 24, 26, 28, 34 form the edges of a generally square box (FIG. 2) when the chair is being assembled.

An additional fold line 30 is formed substantially parallel to, but spaced apart from, fold line 26 by again scoring the sheet material 10. Two additional fold lines 32, 34, respectively, are located substantially perpendicular to the bottom edge 12 adjacent the free edge 72 of left panel 18. Fold lines 30, 34 allow the sheet material 10 to be folded into a substantially flat configuration by accommodating the thickness of the sheet material 10 as it is folded multiple times, as described later in the specification. The fold lines 24–34 extend from the bottom edge 12 to the opposing (top) edge of the sheet material 10.

The sheet material 10 is slotted or cut along an intermittent cut line 36, which is located substantially parallel to the bottom edge 12 at about the middle of the panels 16, 18, and 22. The cut line 36 is intermittent, leaving an uncut portion of the sheet material 10 at about the middle of each of the panels 16, 1, 20, 22. Thus, for example, the cut line 36 extends from the free edge 74 of the back panel 22 toward the middle of the panel, at which point it stops, but resumes shortly thereafter to extend across the fold line 24 to about the middle of the right panel 16, where it again skips a space before resuming to extend across fold lines 26, 30 toward the middle of the front panel 20, where it again skips a space before resuming to extend across fold line 28 toward the middle of the panel 18, where it skips a space before resuming to extend the cut to the free edge of the left panel 18. The cut line 36 is substantially straight, except that it can advantageously curve toward the bottom edge 12 in a generally circular configuration as the cut line 36 crosses fold lines 26, 28 30, and 34. The curving of the cut line 36 defines tab portions 37 which inhibit tearing along fold lines 24, 26, 28 and 34 as the chair is assembled and used.

A series of substantially parallel perforation lines extend from the bottom edge 12 up to where they intersect the ends of the cut line 36. Thus, perforation lines 38, 40 extend perpendicular from the bottom edge 12 to intersect the cut line 36 at the two ends of the cut line 36, where the cut line 36 was interrupted at the center of the panel 22. The perforation lines 38, 40 are spaced apart a distance corresponding to the interruption of the cut line 36. Similar perforation lines 42, 44 are formed in right panel 16. Perforation lines 46, 48 are similarly formed in front panel 20. Perforation lines 52, 54 are similarly formed in left panel 18. The joinder of the perforation lines 38, 40, 43, 44, 46, 48, 52 and 54 with cut line 36 may advantageously be achieved by a small curved cut in order to inhibit tearing of the sheet material during assembly and use of the chair.

The front panel 20 has a fold line 56 which is spaced apart from and substantially parallel to the portion of cut line 36 extending across the panel 20. The fold line 56 may advantageously be formed by perforating the sheet material 10. An outermost top edge 58 of front panel 20 is substantially parallel to the bottom edge 12. About halfway between the outermost top edge 58 and the cut line 36, and substantially parallel thereto, is located a fold line 60 which extends across the width of the front panel 20 and may advantageously be formed by scoring the material 10.

An outermost top edge 62 of left panel 18 is substantially parallel to the bottom edge 12 for about half the width of the panel 18, at which point the outermost top edge 62 curves down to form a curved portion 64 which intersects the perforation line 56 in front panel 20. An outermost top edge 66 of right panel 16 is similar to that of left panel 18 in that the outermost top edge 66 is substantially parallel to the bottom edge 12 for about half the width of the panel 16, at which point it forms a curved portion 68 which curves down to intersect the perforation line 56. Panel 22 has an outermost top edge 70, which is substantially parallel to the bottom edge 12.

The spacing between the various score lines, cut lines and perforation lines varies depending upon the size of the chair 14 (FIG. 4) which is to be produced. For an adult-sized chair, the distance between the perforation lines 38/40, 42/44, 46/48, 52/54 is about two inches between each pair of perforation lines. The distance between the fold lines 24, 26, 28 is about 18 inches. The distance between fold line 24 and adjacent perforation lines 40, 42 is about eight inches. The distance between fold line 26 and adjacent perforation lines 44, 46 is about eight inches. The distance between fold line 28 and adjacent perforation lines 48, 52 is about eight inches. Each of the panels 16, 20, 22 is about 18 inches. Left panel 18 is about 20 inches wide, with the fold line 34 being about 1.5 inches in from the free edge 72 of panel 18, and the fold line 32 being about ½ inch from the fold line 34, or about two inches in from the free edge 72. The distance between fold lines 26, 30 is also about ½ inch.

After the sheet material 10 is scored, cut and perforated as described above, it is folded and joined to form a continuous loop. The area between the fold line 34 and free edge 72 on left panel 18 is coated with an adhesive. The sheet material 10 is then folded at fold lines 28, 26, 24 so that the fold line 34 is substantially coincident with free edge 74 of back panel 22. The adhesive-bearing portion of left panel 18 is then adhered to the overlapping portion of back panel 22 adjacent the free edge 74, in order to form a continuous loop.

Figure 2:
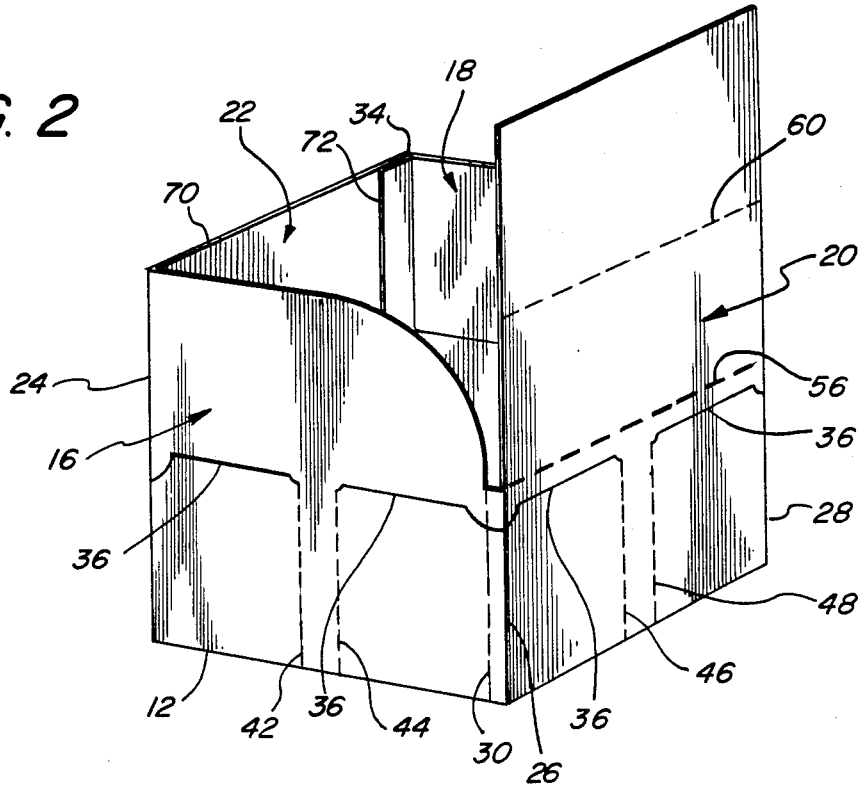
FIG. 2 is a perspective view of the blank of FIG. 1 formed into a continuous loop.
Figure 3:
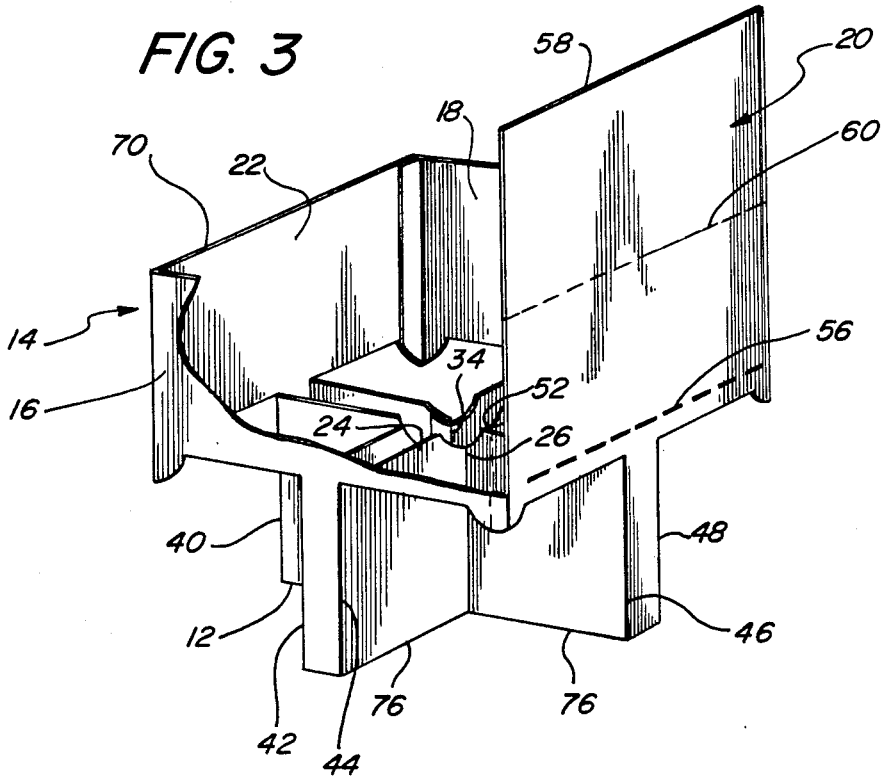
FIG. 3 is a partial perspective view of FIG. 2 with the leg portions of the chair formed.

When folded at the fold lines 24,26, 28 and 34, as previously described, the continuous loop takes the form of the substantially square box as shown in FIG. 2. From the configuration of FIG. 2, the chair 14 can be formed as shown in FIGS. 3 and 4.

Four legs 76 are formed by pushing the four lower outer corners of the square, shown in FIG. 2, into the middle of the chair. These corners which form the chair legs 76 (FIG. 3) are defined by the portion of fold lines 24, 26, 28 and 34 which are located between the cut line 36 and the bottom edge 12. Alternately phrased, with respect to fold lines 130, 132, 124, 134, 136, 126, 138, 140, 128, 142, 144 and 194, the legs are formed by placing every third fold line on the inside of the continuous loop of material. Thus, the portion of the sheet material 10 located between the cut line 36 and the lower edge 12 forms the legs 76 of the chair 14. In doing so, a portion of the fold lines 24, 26, 28, and 34 are positioned inward and adjacent one another to form legs 76 which take the general form of a cross or "X." The width of the legs 76 is defined by the space between the pairs of perforation lines 38/40, 42/44, 46/48, 52/54. The "cross" nature of the legs 76 is shown best in FIG. 5.

To complete the chair 14, a seat portion is formed by folding the top portion of panel 18, located between the fold line 56 and the outermost top edge 58, along fold line 56 down on top of the legs 76, as shown in FIG. 4. There is thus provided a chair 14 having a legs 76, a seat (fold line 56 to outermost top edge 58), armrests (top edges 62, 64, 66, and 68 to cut line 36), and a back rest (outermost top edge 70 to cut line 36).

The above steps are performed in reverse order to collapse or fold the chair 14 into a more portable configuration. Thus, the interior corners of the legs 76 are pushed outward so that they form the outside corners, defined by fold lines 24, 26, 28 and 34, of the box configuration as shown in FIG. 2. The top portion of the panel 18, between fold line 56 and top edge 58, is raised from its horizontal position into a vertical position substantially parallel to the back panel 22. At this point the configuration of FIG. 2 is achieved.

The packaged configuration is then achieved as described by referring to FIG. 6. The fold lines 26, 30 are placed substantially parallel to and immediately adjacent to the fold lines 32, 34. This forms a substantially rectangular configuration, the opposing ends of which are formed by fold lines 24, 28. The top portion of the front panel 20, located between the fold line 60 and the outermost top edge 58 (FIG. 1), is then folded outward and downward, pivoting about fold line 60 so that the outermost top edge 58 is placed adjacent to the cut line 36 on the exterior portion of the front panel 20. This forms a substantially rectangular configuration.

Referring to FIG. 7, the rectangular configuration is then changed into a flat, generally square configuration by folding the rectangle in the middle. The fold lines 24, 28 are placed immediately adjacent one another. In this configuration, the space between the fold lines 26, 30 and 32, 34 overlap and provide sufficient space to accommodate the thickness of the intervening material of the panels 16, 20. When completely collapsed, the configuration is that of a generally flat, square sheet approximately 28 inches on a side and about one inch thick.

To unfold the package, the process is reversed, with the fold lines 24, 28 being separated. The portion of front panel between fold line 69 and outermost top edge 58 is straightened. The fold lines 32, 34 and 26, 30 are separated in order to form a box-like configuration with a substantially square horizontal cross-section, as generally shown in FIG. 2, and from which the chair 14 (FIG. 4) can be assembled.

There is thus provided a chair which can be folded into a lightweight, compact configuration and which can be made out of lightweight, yet sturdy, material such as cardboard. The chair is of sufficiently small size and weight that it is readily portable. The chair is sufficiently inexpensive to manufacture that it can be disposed of or discarded after one or a relatively few uses. The bottom portion of the chair can be reconfigured to form a cross-leg configuration which provides a high degree of stability and distributes the weight of the person sitting in the chair. The top edges 62, 64 and 66, 68 of the side panels 16, 18 form the side arms of the chair 14. The configuration can be altered, especially the shape of the curved portions 64, 68, in order to vary the style of the chair to accommodate the comfort of a person sitting in the chair 14.

Figure 8:
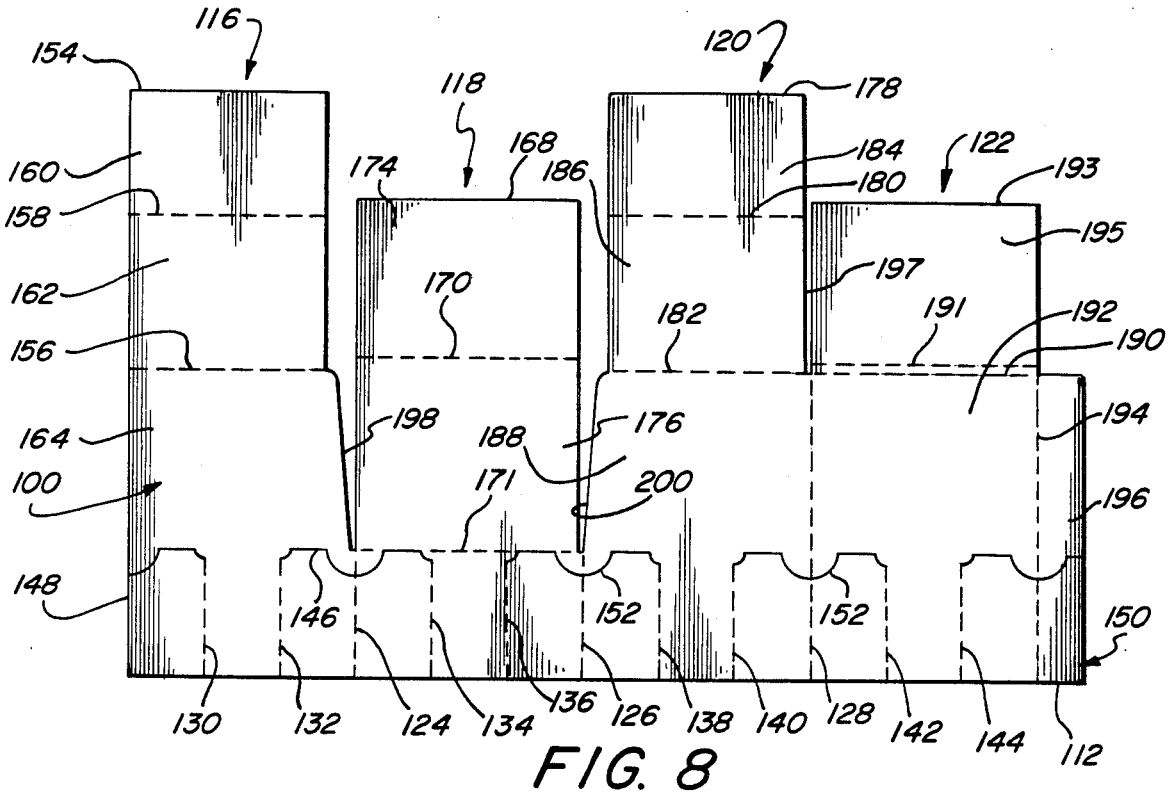
FIG. 8 is a top plan view of an alternate embodiment of a blank of sheet material from which a chair of a second preferred embodiment of this invention can be assembled.
Figure 12:
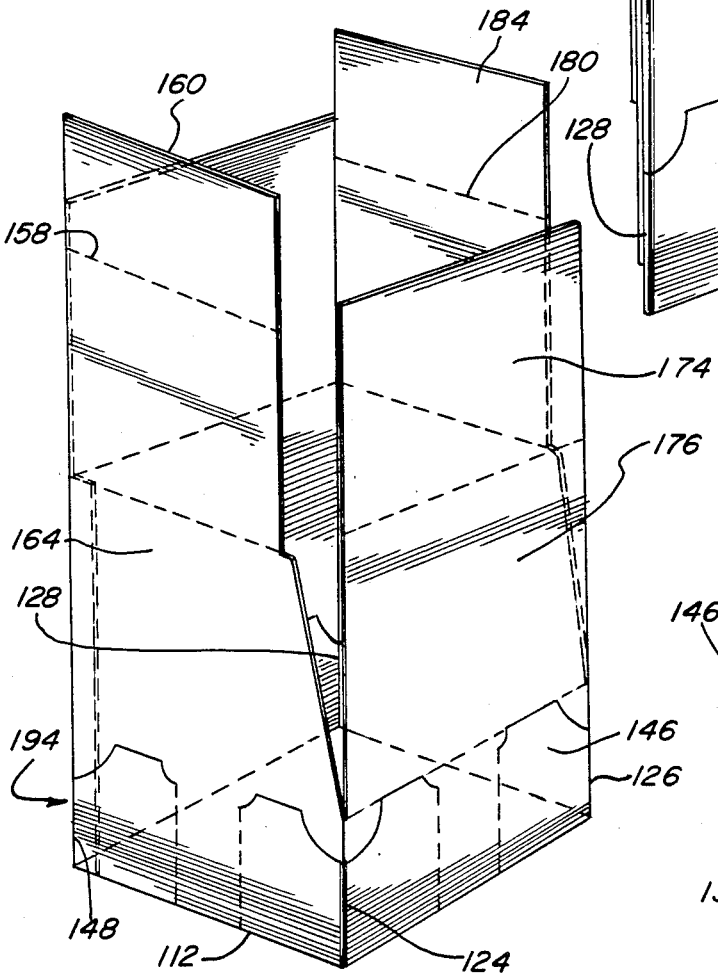
FIG. 12 is a perspective view of a the blank as shown FIG. 8 formed into a continuous loop.
Figure 13:
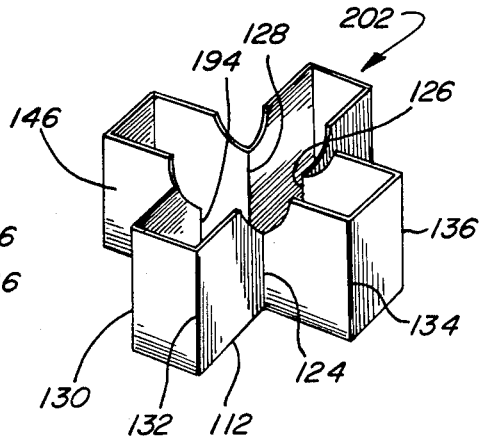
FIG. 13 is a partial section, perspective view of a the legs of the chair formed from the continuous loop of material shown in FIG. 12.
Figure 14:
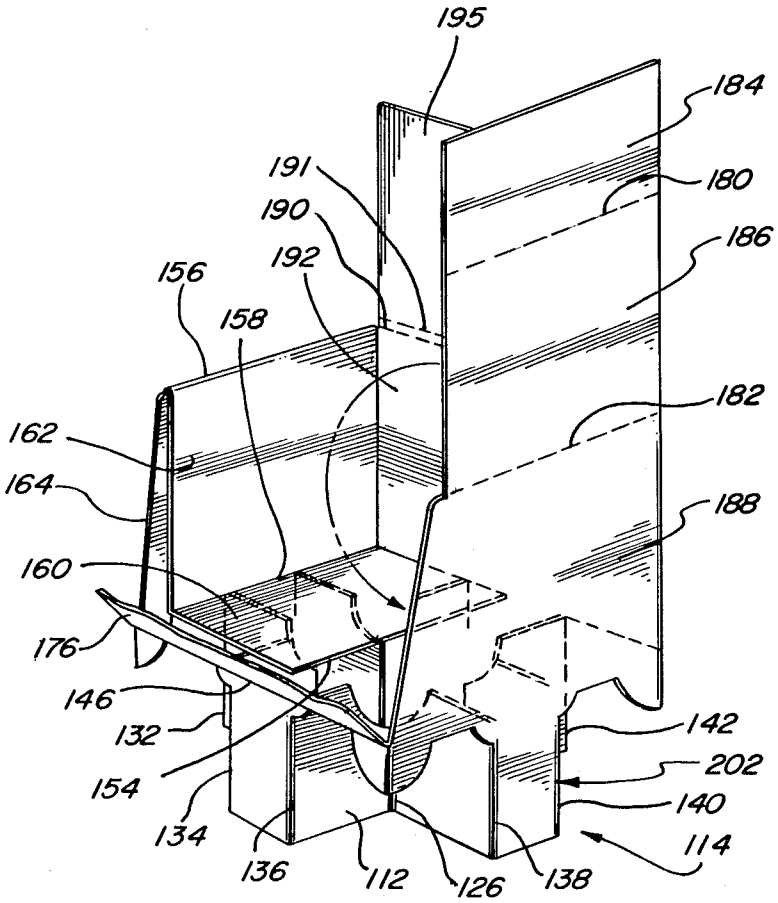
FIG. 14 is a perspective view of a partially assembled chair assembled from the blank shown in FIG. 8.

A second embodiment of this configuration is shown in FIGS. 8–15. Referring to FIG. 8, there is a piece of sheet material 100 having a bottom edge 112 which is used to form a chair 114 (FIG. 14). The material 100 can advantageously comprise 275 pound, single wall, corrugated. The sheet material 100 is generally divided into four panels. Identified from left to right, the panels are right panel 116, front panel 118, left panel 120 and back panel 122, with the panel names corresponding to the location of the panels in the assembled chair 114 (FIG. 14.

A plurality of fold lines separate the panels 116, 118, 120, 122. Fold line 124 extends substantially perpendicular to the bottom edge 112 and is located at the juncture of panels 116, 118. Fold line 126 is similarly located between the front panel 118 and left panel 120. Fold line 128 is similarly located between left panel 120 and back panel 122. The fold lines 124, 126, 128 are preferably perforated.

Located at about the middle of each of the panels 116, 118, 120, 122 are a pair of substantially parallel fold lines, preferably scored, which extend perpendicular from the edge 112 for a predetermined distance which corresponds to the height of the legs of the chair 114. For the described embodiment, which is a child's chair, that leg height is about 8 inches. Thus, at about the middle of panel 116, there are located a pair of fold lines 130, 132, with the fold lines being spaced about 3.75 inches apart. Similarly, in panel 118, fold lines 134, 136 are spaced apart by about 3.75 inches and extend inward from the bottom edge 112, at about the middle of the panel 118. Similar fold lines 138, 140 are similarly located in left panel 120, and fold lines 142, 144 are similarly located in rear panel 122.

An intermittent cut line 146 is located substantially parallel to the bottom edge 112 and extends between the interior ends of the adjacent fold lines on adjacent panels. Thus, the intermittent cut line 146 extends between the interior ends of fold lines 132, 134, between 136, 138 and between 140, 142. The intermittent cut line !46 also extends from the interior end of fold line 144 to a free edge 150 of the back panel 122, and similarly extends from the interior end of fold line 130 to a free edge 148 of the right panel 116. The intermittent cut line !46 does not extend between the pairs of fold lines located at about the center of each of the panels. Thus, there is no cut between the fold lines 130, 132, between 134, 136, between 138, 140 or between 142, 144.

As shown in FIG. 8, the intermittent cut line 146 is substantially straight, but contains several curved tab segments 152 which extend toward the bottom edge 112 adjacent each of the fold lines 124, 126, 128 and adjacent the free edges of the panels 116, 122 where the intermittent cut line 146 intersects those edges 148, 150. The curved segments 152 are advantageously segments of a circle having a radius of about 1.50 inches and preferably comprising about half of a circle, except for the curved segments 152 on the free ends 148, 150, which may be less than half a circle. The curved segments 152 help inhibit tearing of the material 100 as the chair is assembled and used.

The right panel 116 extends in a direction substantially perpendicular to the bottom edge 112, and has a generally rectangular shape, the long edge of which is formed by edge 148. An outermost top edge 154 marks the end of the right panel 116, with the edge 154 being substantially parallel to and opposite the bottom edge 112. Between the cut line 146 and outermost top edge 154 are located first and second right panel fold lines 156, 158, respectively, each of which are substantially parallel to the bottom edge 112, and extend the width of right panel 116, with the right second panel fold line 158 being located nearest the outermost top edge 154. The fold line 156 is preferably perforated, while the fold line 158 is preferably scored in the material 100. The portion of the right panel 116 located between the outermost top edge 154 and second right panel fold line 158 will be referred to as the right panel seat portion !60, while the portions of the panel 116 located between right panel fold lines 156, 158 will be referred to as the side portion 162. The segment of the right panel 116 located between first right panel fold line 156 and the cut line 146 comprises the right exterior side 164 of chair 114 (FIG. 14) when the chair is assembled.

The front panel 118 is substantially rectangular in shape as to that portion between the cut line 146 and an outermost top edge 168, with that portion being separated from the left panel 120 and right panel 116. The front panel 118 is divided into portions in a manner analogous to the right panel 116. Thus, the front panel 118 has an outermost top edge 168 substantially parallel to the bottom edge 112. First and second front panel fold lines 170, 171 respectively, extend across the width of the front panel 118 and are substantially parallel to the bottom edge 112. The fold lines 170, 171 are preferably scored. The fold line 171 is coincident with a portion of the intermittent cut line 146 and extends across the intermittent portions of cut line 146.

The fold lines 170, and 171 divide the front panel 118 into various portions. A back brace portion 174 is located between the outer edge 168 and fold line 170. A seat portion 176 is located between fold line 170 and front panel fold line 171.

The left panel 120 is similar in construction to the right panel 116. At the portion furthest from the bottom edge 112 is an outermost top edge 178 which is substantially parallel to the bottom edge 112. Substantially parallel to and space apart from the outermost top edge 178 is a second left panel fold line 180 which extends across the width of the left panel 120. Between the fold line 180 and the cut line 146, and substantially parallel to those lines, is located a first left panel fold line 182 which extends from the edge of the left panel 120 to the fold line 128. The fold line 182 is preferably perforated, and fold line 180 is preferably scored in the sheet material 100.

The portion of the left panel 120 located between the outermost top edge 178 and second left panel fold line 180 comprises the seat portion 184. A side portion 186 comprises that portion of the left panel 120 located between first and second left panel fold lines 182, 180, respectively. A left exterior side 188 comprises that portion of the left panel 120 located between first fold line 182 and cut line 146. The outer portion 184 and middle portion 186 are substantially rectangular in shape.

The back panel 122 has an edge 190 located substantially parallel to the bottom edge 112, with the top 190 being located at about the same distance from the bottom edge 112 as are the fold lines 156 and 182. A back portion 192 is located between the edge 190 and the cut line 146, and joins the left exterior side 188 along fold line 128. The edge 190 forms the edge of back rest portion of the chair when it is assembled for a person to sit in it.

Spaced slightly inward from and substantially parallel to the free edge 150 is located a scored fold line 194. The portion between the fold line 194 and the free edge 150 comprises a glue tab area 196.

In this embodiment, the edge 190 comprises a perforated fold line, which as previously mentioned, corresponds in location to the first fold lines 156 and 182 on panels 116 and 120, respectively. Spaced about one half inch from, and substantially parallel to the edge 190 is a perforated fold line 191. An outer edge 193 is located furthermost from the bottom edge 112 on back panel 122. A back rest panel 195 is located between the perforated fold line 191 and the outer edge 193. The back rest portion 195 is adjacent the left panel 120, but is separated therefrom by a cut line 197 so that the back rest portion 195 can rotate about fold line 191 without restriction from the left panel 120. The edge of the panel 195 opposite the cut line 197 is substantially coincident with an extension of fold line 194, and will be referred to as a portion of fold line 194.

Opposite the free edge 148 on the right exterior side portion 164 is located an edge 198 which extends from one end of the fold line 156 to a location adjacent the intersection of the fold line 124 and the cut line 146. A similar free edge 200 is located on the left exterior side portion 188 opposite the fold line 128, and extending between one end of the fold line 182 to about the intersection of fold line 126 with the cut line 146. The free edges 198, 200 correspond to the curved portions 64, 68 (FIG. 1).

The location of right panel fold lines 156, 158, with respect to the bottom edge 112, correspond generally to the location of left panel fold lines 182, 180, respectively. For a child's sized chair, the distance edge 112 and cut line 146 is about 8 inches. The distance between the cut line 146 and fold lines 156, 182 is about 8 inches. The distance between fold lines 156 and 158 is about 7.5 inches. The distance from fold line 158 to outermost top edge 154 is about 7 inches and corresponds to the distance between the fold line 180 and the outermost top edge 178. The distance between cut line 146 and fold line 170 is about 9 inches, with the distance between lines fold 170 and 168 being about 8.5 inches.

Figure 9:
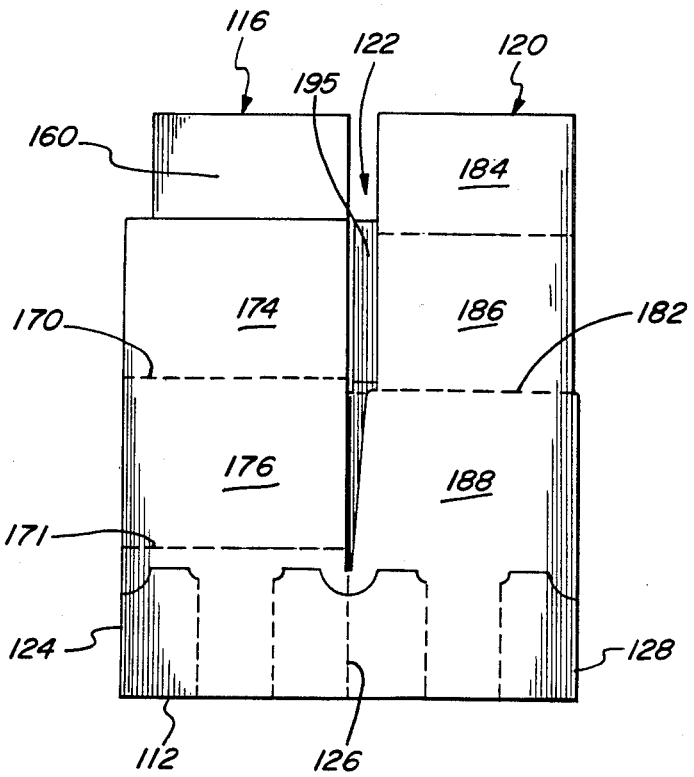
FIG. 9 is a perspective view of a partially folded chair from the blank shown in FIG. 8.

After the above-described cut lines, fold lines and perforations are made in the sheet material 100 to form the 116, 118, 120, 122, the sheet material 100 is formed into a continuous loop, as shown in FIG. 9. Referring to FIG. 8, this continuous loop is formed by placing adhesive material on the glue tab area 196 and folding the sheet material 100 about fold lines 124, 126, 128 so that the fold line 194 is substantially adjacent the free edge 148 on panels 164 and the leg portion of right panel 116. The adhesive on the glue tab 196 adheres the back panel 122 to the right panel 116 in order to form a continuous loop, with the bottom edge 112 forming a continuous loop lying in substantially one plane, as shown in FIG. 9.

Referring to FIG. 9, for packing and shipping purposes, the continuous loop of material 100 is folded into a planar configuration. In order to do so, the sheet of material 100 is folded along fold lines 124, 128 so that the fold line 148 is placed adjacent the foldline 126. This results in the seat portion 192 being adjacent the left exterior side 188, and the right exterior side 164 is adjacent the back portion 176 (hidden in FIG. 9). In essence, the back panel 122 is placed adjacent the right panel 116, and the left panel 120 is placed adjacent the front panel 118.

Figure 10A:
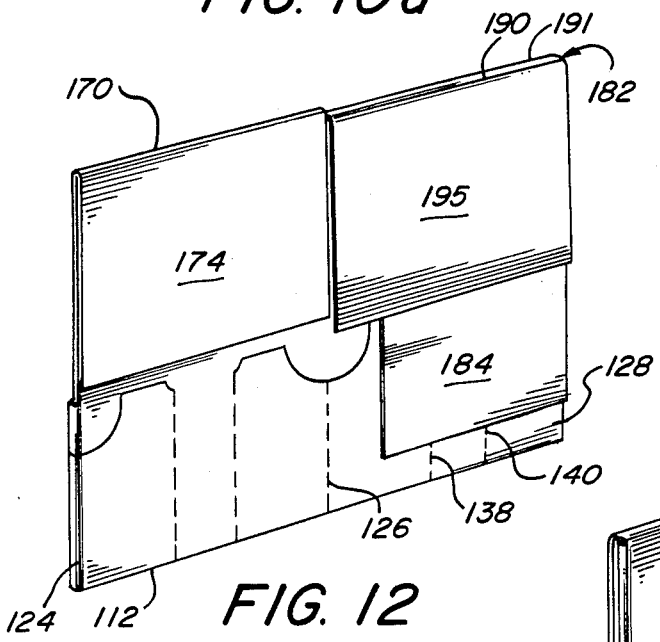
FIG. 10*a* is a perspective view taken from one side of a partially folded chair from the blank shown in FIG. 8.
Figure 10B:
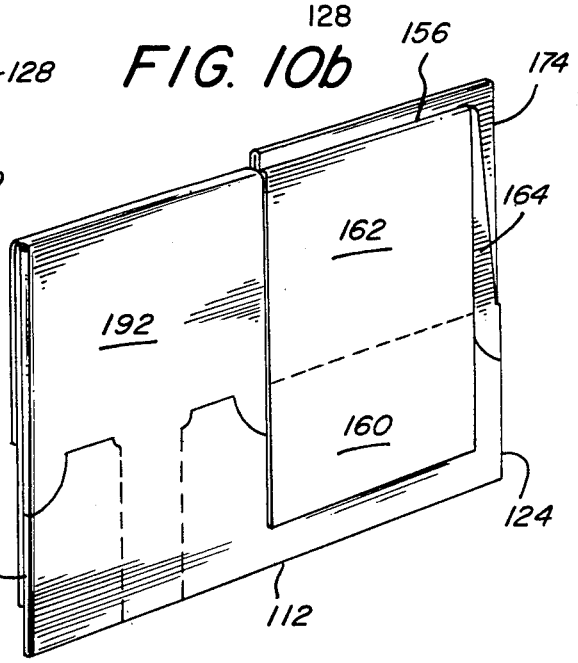
FIG. 10*b* is a perspective view taken from the opposite side as in FIG. 10*a*, of a partially folded chair from the blank shown in FIG. 8.

From the planar configuration shown in FIG. 9, the continuous loop of sheet material 100 is then folded into the rectangular configuration shown in FIGS. 10*a* and 10*b*. As one skilled in the art can determine, the various panels could be folded in different directions and combinations to achieve a substantially rectangular configuration. The folding combination which is believed advantageous is shown in FIGS. 10*a* and 10*b*. Referring first to FIG. 10*a*, back brace panel 174 is folded about fold line 170 and placed against panel 176. Panel 186 is folded along line 182 (FIG. 8) and placed against panel 188 (FIG. 8). Panel 195 is folded along lines 190, 191 and is folded over and against panel 186 so that panel 186 is between panel 195 and 188. The space between fold lines 190, 191 accommodates the thickness of the various panels when the panel 195 is folded. Referring to FIG. 10*b*, the opposite side of the rectangle is shown, in which panel 162 is folded along fold line 156 to abut panel 164.

Figure 11:
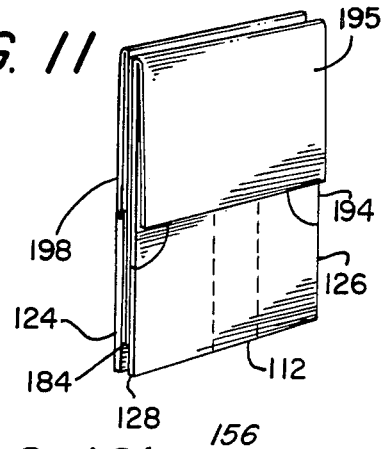
FIG. 11 is a perspective view of a folded chair from the blank shown in FIG. 8.

Referring to FIG. 11, the rectangular configuration of FIG. 10 can then be folded into a substantially flat, square configuration. Folding the pieces about fold lines 126, 194, a substantially square configuration can be formed wherein fold line 128 is placed adjacent fold line 124. There is thus formed a substantially square, flat configuration which is very compact and portable. If the chair 114 is shipped in the configuration shown in FIG. 11, it is unfolded by reversing the process in steps shown with respect to FIGS. 9 to 11.

Once the planar configuration of FIG. 9 is obtained, a box configuration can be obtained by separating the fold line 126 from fold line 194 to form a substantial box-like configuration, as shown in Figure 12. The fold lines 194, 124, 126, and 128 (in phantom) form the corners of a square, with each of the fold lines intersecting the bottom edge 112. Each of the perforated corners of the square located between the cut line 146 and the bottom edge 112 are folded toward the inside of the square along fold lines 124, 126, 128, 194. The pairs of perforations on the lower portion of each of these panels 116, 118, 120, 122 form fold lines which, with the relocation of corners 124, 126, 128, 194 serving to define four legs 202, which for a "X", or cross, configuration.

This leg configuration is best seen in the partial perspective of FIG. 13. Thus, one of the four legs 202 of the chair are formed by fold lines 124, 134, 136, 126, with an adjacent, substantially perpendicularly-oriented leg 202 being formed by fold lines 124, 132, 130, 194. The top and bottom of the legs are defined by the bottom edge 112 and the intermittent cut line 146.

Once the legs 202 of the chair are formed, the upper portions of one of the side panels 116, 120 are folded to form the sides of the chair and provide a seat support. Thus, for example, the right side portion 162 of right panel 116 is folded along fold line 156 toward the inside of the continuous loop or box so that the side portion 162 is placed adjacent the side portion 164. The seat portion 160 of right panel 116 is folded along fold line 158 so that it is substantially parallel to the bottom edge 112, and rests on the top of at least a portion of the legs 202.

The left panel 120 is folded in an analogous manner so that side portion 186 is adjacent the side portion 188, and seat portion 184 is abutting the top of the legs 202. There may be some overlap between the seat portions 184, 160 when they are folded into position. The portions 162, 164 and portions 188, 186 form the right and left sides of the chair 114, respectively. The portions 160, 184 form a seat support of the chair 114.

Figure 15:
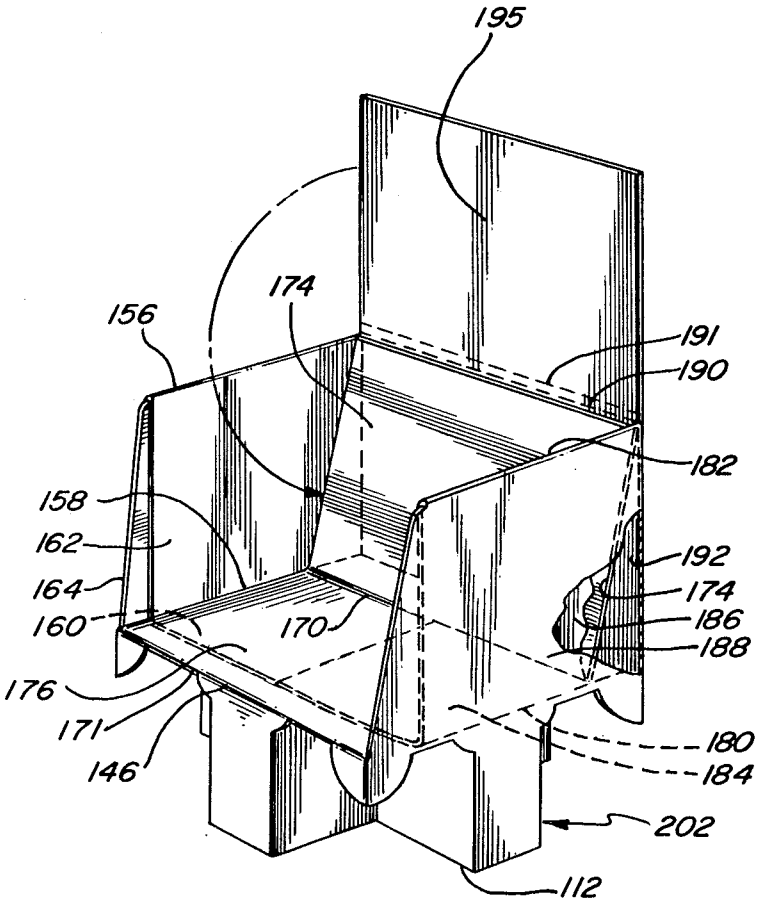
FIG. 15 is a perspective view of a partially assembled chair assembled from the blank shown in FIG. 8.

Referring to FIG. 15, the front panel 118 (FIG. 9) is then folded to complete the formation of the seat and back of the chair 114. The seat portion 176 of front panel 118 is folded along fold line 171 so that the seat portion 176 rests on top of the seat portions 160, 184 which, in turn, are abutting against the top of the legs 202. The back brace portion 174 folds back at an angle toward the back portion 192. The back rest portion 195 is then folded along lines 190, 191 on top of back brace portion 174 to hold it into place and provide added support for a person's back when sitting in the chair 114. Thus, the seat portion 176 forms a seat of the chair 114, the back brace portion 174 forms the back of the chair in conjunction with the back rest portion 195. The back portions 174, 195 are advantageously inclined and overlap a corner of the side portions 162, 184 so as to hold them into place.

The extra portions on the panels 116, 118, 120 serve to provide additional material on the sides, seat and back of the chair 114. This additional material increases the chair's stability and increases the load-carrying capability of the chair 114. Despite this increased stability and strength, the chair 114 can still be folded into a very compact and lightweight configuration, and can be assembled into its operational chair configuration or be packaged into the compact configuration with a minimal amount of effort. The tabs or curved segments 152 allow various joints of the chair 114 to move without tearing the cardboard material of which the chair 114 is fabricated.

Figure 16:
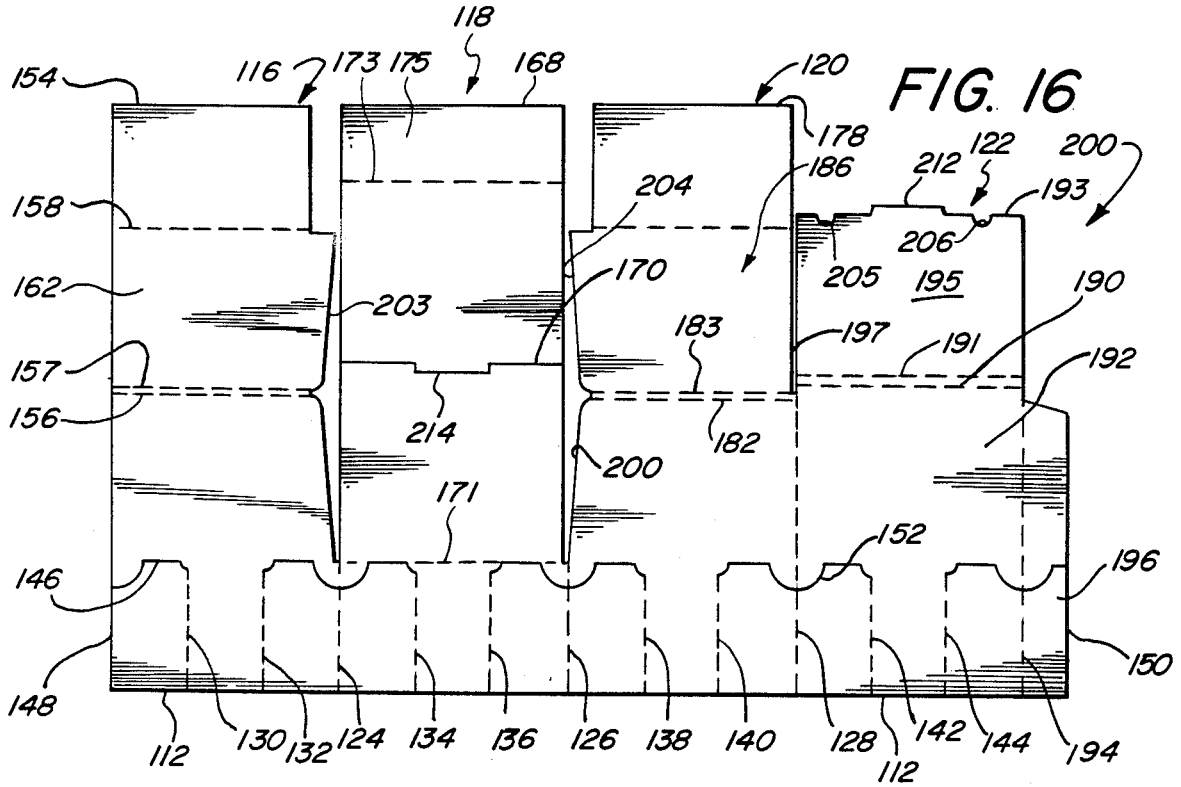
FIG. 16 is a top plan view of an alternate embodiment of a blank of sheet material from which a chair of a third preferred embodiment of this invention can be assembled.

A third embodiment is shown in FIG. 16. In this alternate configuration, there is an additional brace on the back of the chair, and a lock to hold the chair in the assembled position, but substantial portions of the design are the same as shown in FIGS. 8–15. These identical portions will not be re-described herein, but will be referred to by these same numbers.

Referring to FIG. 16, there is a sheet of material 200 in which are cut a right panel 116, a front panel 118, a left panel !20 and a back panel !22. An extra panel is added to the front panel 118. A fold line 173 is located intermediate fold line 170 and outermost edge 168, to define a back second brace panel 175. In this embodiment, edge 168 is on substantially the same line as edges 154 and 120, so that each of the panels 116, 118 and 120 are substantially the same length.

At about the middle of the fold line 170, there is formed a jogged cut line 214. The cut line 214 jogs off from the fold line 170 about a half inch and then runs substantially parallel to the fold line 170 for a distance of about 6 inches, after which the cut line 214 jogs back and rejoins the fold line 170. The jogged cut line 214 forms an aperture when panels 174, 176 are folded along fold line 170.

The edges 203, 204 of side portions 162 and 186, respectively, which are located adjacent the front panel 118, are cut in a configuration which mirrors the free edges 198 and 200, respectively. If folded along the fold lines 156, 182, the free edge 203 would coincide with free edge 198, and free edge 204 would coincide With free edge 200, as partially shown in FIG. 17.

Referring to FIG. 16, on the right panel 116, adjacent the fold line 156, there is added a spaced apart fold line 157 which is substantially parallel to, and spaced slightly apart from, fold line 156. A spacing of about 0.25 inches is believed sufficient. Another spaced apart fold line 183 is substantially parallel to, and spaced about 0.25 inches apart from fold line 182. The fold lines 156, 157 facilitate folding of the right panel 116 for packaging, by forming a hinge which accommodates the thickness of the sheet material from which the chair is made. Similarly, the fold lines 182, 183 facilitate folding of the left panel 120 for packaging by forming a hinge to accommodate the thickness of the sheet material.

Referring now to the back panel 122. At about the middle of the outer edge 193 is located a tab 212 which advantageously takes the form of a rectangular protrusion which sticks out from the outer edge 193. A tab protruding about a half inch, for a length of about 5 inches, is believed sufficient. Two indentations 205, 206, are located on the edge 193, one on each side of the tab 212. The indentations can advantageously take the form of semicircular cuts in the edge 193, about 0.75 inches wide, large enough to slip a person's finger into.

Figure 17:
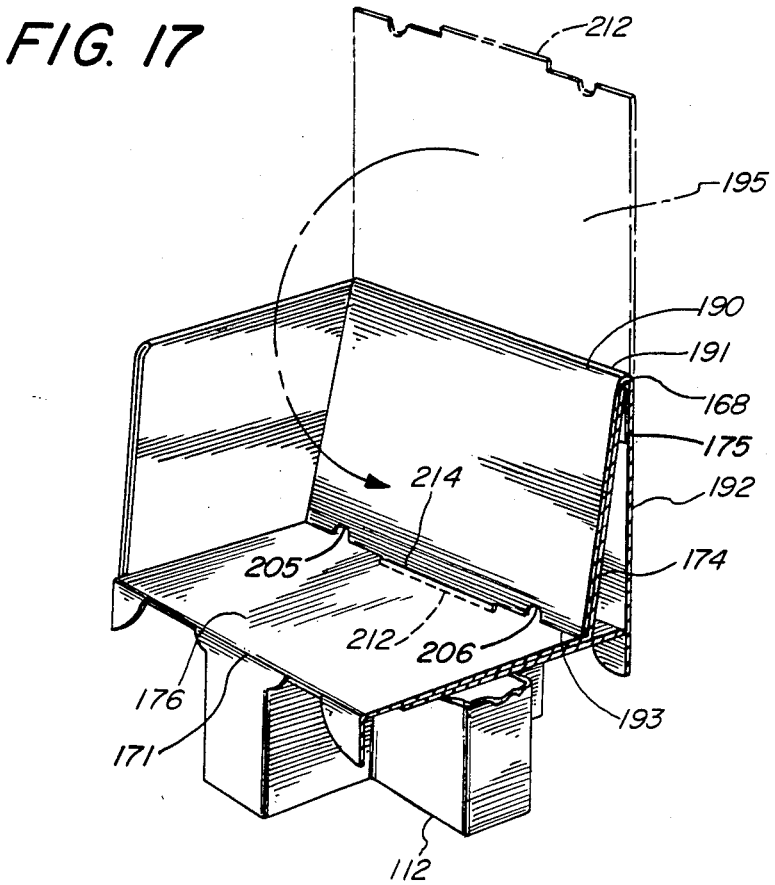
FIG. 17 is a partial perspective view of a partially folded chair from the blank shown in FIG. 16.

Referring to FIG. 17, the chair 216 of this third embodiment is assembled according to the steps described with respect to FIGS. 12–15, except that the second back brace panel 175 is folded along fold line 173 to so it abuts the back portion 192 to provide a localized brace along the top edge 190. After those steps are completed, the back rest portion 195 is folded along fold lines 190, 191 so that the back rest portion 195 is placed adjacent the first back brace portion 174 of front panel 118, with the tab 212 being inserted into the aperture formed by cut line 214 in order to lock the seat and backrest into position. The indentations 205, 206 form apertures into which a person can slip a finger in order to remove the tab 212 from the slot 214.

The above-described alternative embodiment can be advantageously used for an adult-sized chair. Suitable dimensions for one such use have the distance between cut line 146 and fold line 156 is about 10 inches, the distance between fold lines 156, 158 is about 10 inches and the distance between fold line 158 and outermost top edge 154 is about 12 inches. On front panel 118, the distance between the outermost top edge 168 and fold line 173 is about 3.5 inches. The distance between fold line 173 and 170 is about 11.5 inches. On left panel 120, the location of fold lines 182, 180 and outermost top edge 178 correspond respectively to fold lines 156, 158 and outermost top edge 154 of the right panel 116. For the back panel 122, the distance between fold line 190 and the intermittent cut line 146 is about 10.5 inches. Fold lines 190, 191 are about a half inch apart, and outer edge 193 is about 10.5 inches from fold line 190. The distance between free edge 148 and fold line 130 is about 6.5 inches, which is the same for the distance between fold lines 132/124, 124/134, 136/126, 126/138, 140/128, 128/142 and 144/194. The distance between the pairs of fold lines located at about the middle of each of the panels is about 4.75 inches. Thus, there is about 4.75 inches between lines 130/132, between lines 134/136, between lines 138/140 and between lines 142/144. There is about 1.5 inches between fold line 194 and free edge 150. The distance between the bottom edge 112 and the intermittent cut line 146 is about 12 inches. The curved segments 152 have an arc with a height of about 2 inches, with a cord of 4 inches measured along the straight portion of the cut line 146.

There is thus provided a chair that has an outline that is substantially square in two dimensions, or cubic in three dimensions, and which is formed from a substantially rectangular sheet of material. The chair has a first, folded position for ease of transportation, and a second, chair position in which a person can sit in the chair. In this first, folded position, the chair comprises a substantially flat, generally square configuration in which two dimensions are substantially smaller than the unfolded configuration, and in which one dimension is substantially smaller than the assembled, chair configuration.

The chair of the above embodiments advantageously provides a large amount of exposed surface area on which printed indicia, such as advertisements, may be placed. Thus the chairs of this invention may advantageously be used as promotional items in which a sponsor may place advertising on the surfaces of the chair which are exposed when the chair is assembled. Thus for example, advertisements may be printed on one surface of the blank sheet of material in order to display advertisements on portions 162, 174, 176, 186, 195, and the portions between intermittent fold line 146 and fold lines 156, 170, 182 and 190. There is thus advantageously provided a relatively inexpensive promotional vehicle configured have a large surface area on which printed indicia may be placed for advertising purposes.

The above embodiments of this invention have been described with respect to certain lines being perforated or scored. That particular fold lines are perforated, while others are scored, is the preferred embodiment, and is not intended to limit the scope of the invention.

The above invention has been described with reference to preferred embodiments. Modifications and alterations will occur to others upon the reading and understanding of this specification. It is intended to include all such modifications and alterations insofar as they come within the scope of the appended claims or the equivalents thereof.

What is claimed is:

1. A blank for a chair, comprising:

a sheet of material having thickness, a substantially straight bottom edge, an outermost top edge opposite thereto, and two free ends joining the bottom and outermost top edges, the sheet having four panels defined by corner fold lines to form a front, back, left, and right panel;

a pair of substantially parallel center fold lines located at about the center of each of the four panels, extending from the bottom edge toward the outermost top edge, oriented substantially perpendicular to the bottom edge, and terminating at an end point;

an intermittent cut line extending through the thickness of the sheet of material, the cut line being spaced apart from, but running along the length of the bottom edge, the cut line extending from the end point of one center fold line on one panel to the end point of the nearest center fold line on the adjacent panel, and extending from the end point of the fold lines adjacent the free ends of the sheet of material, toward the adjacent free end, so as to leave the space between each pair of center fold lines substantially uncut;

at least one, first seat fold line, substantially parallel to the bottom edge, located between the intermittent cut line and the outermost top edge, and extending across at least one of the panels, with the portion of the panel located between the seat fold line and the outermost top edge defining a seat area; and a connecting area along at least a portion of one of the free edges, shaped to interact with a corresponding area on the opposite free edge in order to allow the sheet of material to be joined into a continuous loop.

2. A blank for a chair as defined in claim 1, wherein said cut line is substantially parallel to said bottom edge, and said bottom edge is straight.

3. A blank for a chair as defined in claim 1, wherein said cut line curves toward said bottom edge adjacent each of the corner fold lines.

4. A blank for a chair as defined in claim 1, wherein said seat fold line is located on the front panel.

5. A blank for a chair as defined in claim 4, further comprising a second fold line located between the seat fold line and the outermost top edge, the outermost top edge of each of the remaining panels corresponding to the height at which the second fold line is located, the second fold line allowing the seat portion to be folded into a configuration one dimension of which corresponds to the distance between the bottom edge and the outermost top edges of the panels.

6. A blank for a chair as defined in claim 5, wherein at least a portion of said left and right panels are shaped to form arm rests of a chair when the blank of material is assembled into a chair.

7. A blank for a chair as defined in claim 6, wherein said connecting area comprises a generally rectangular area along the length of one the free edges on which adhesive can be placed in order to glue the two free edges together to form a continuous loop.

8. A blank for a chair as defined in claim 1, further comprising:

a first and second right panel fold between the cut line and the outer edge of the right panel, with the first right panel fold line being close to the cut line, but spaced from the cut line at a distance corresponding to the height of the arms of a chair, the first and second fold lines on the right panel being substantially parallel to the cut line, and extending across the right panel, the portion between the first and second fold lines of the right panel defining a right side portion, and the portion between the second fold line and the outer edge of the right panel defining a right seat portion;

a first and second left panel fold line located between the cut line and the outer edge of the left panel, with the first left panel fold line being close to the cut line, but spaced from the cut line at a distance corresponding to the height of the arms of a chair, the first and second fold lines on the left panel being substantially parallel to the cut line, and extending across the left panel, the portion between the first and second fold lines of the left panel defining a left side portion, and the portion between the second fold line and the outer edge of the left panel defining a left seat portion; and a first and second front panel fold line located between the seat fold line and the outer edge of the front panel, with the first front panel fold line being closest to the seat fold line, but spaced from the seat fold line at distance approximating the depth of the seat for a chair formed from the blank of sheet material, the first and second fold lines on the right panel being substantially parallel to the seat fold line, and extending across the right panel, the portion between the first and second fold lines of the front panel defining a back rest portion, and the portion between the second fold line and the outer edge of the front panel defining a back brace portion.

9. A blank for a chair as defined in claim 8, wherein said cut line is substantially parallel to said bottom edge, and said bottom edge is straight.

10. A blank for a chair as defined in claim 8 wherein said cut line curves toward said bottom edge adjacent each of the corner fold lines.

11. A blank for a chair as defined in claim 10, wherein at least a portion of said left and right panels are shaped to form arm rests of a chair when the blank of material is assembled into a chair.

12. A blank for a chair as defined in claim 11, wherein said connecting area comprises a generally rectangular area along the length of one the free edges on which adhesive can be placed in order to glue the two free edges together to form a continuous loop.

13. A blank for a chair as defined in claim 8, wherein said back panel further comprises a first back panel fold line located between the cut line and the outer edge of the back panel, the first back panel fold line being substantially parallel to the cut line, and extending across the back panel, the portion between the first fold line of the back panel and the outer edge defining a back brace portion.

14. A blank for a chair as defined in claim 13, further comprising:

a tab on said outer edge of the back panel; and a slot in said first front panel fold line, positioned such that the tab can be inserted into the slot when the sheet of material is assembled into a chair, with the tab locking the back brace portion into position with respect to the front panel seat portion.

15. A blank for a chair as defined in claim 13, wherein said cut line curves toward said bottom edge adjacent each of the corner fold lines to form a curved tab segment around a portion of the intersection of at least two fold lines.

16. A blank for a chair as defined in claim 1, wherein the sheet of material is formed into a continuous loop by joining the connecting area to the material adjacent the opposing free edge.

17. A blank for a chair as defined in claim 8, wherein the sheet of material is formed into a continuous loop by joining the connecting area to the material adjacent the opposing free edge.

18. A blank for a chair as defined in claim 11, wherein the sheet of material is formed into a continuous loop by joining the connecting area to the material adjacent the opposing free edge.

19. A blank for a chair as defined in claim 13, wherein the sheet of material is formed into a continuous loop by joining the connecting area to the material adjacent the opposing free edge.

20. A foldable chair, comprising:

a substantially rectangular sheet of material joined to form a continuous loop, having a bottom edge thereon, the continuous loop of material being positionable in a first, substantially flat packaged configuration, and positionable in a second, chair configuration;

a plurality of fold lines generally perpendicular to the bottom edge, the fold lines having an interior end opposite the bottom edge, with an intermittent cut line joining a plurality of the fold lines, the cut line enabling a plurality of the fold lines to be repositioned inside of the continuous loop to define a plurality of legs having a bottom for resting against the ground, and a top, when the continuous loop of material is in the second, chair configuration;

a seat portion on said sheet of material which can be positioned to rest against the top of the legs to form a seat when the continuous loop of material is in the second, chair position;

side portions on said sheet of material which form arm rests when the continuous loop of material is in the second, chair position; and a back portion on said sheet of material, connecting said side portions, and forming a back rest when the continuous loop of material is in the second, chair position.

21. A chair as defined in claim 20, wherein said first substantially flat position is substantially smaller than is said second chair position and comprises a substantially square, flat configuration.

22. A chair as defined in claim 20, wherein said legs are defined by repositioning every third fold line inside of said continuous loop.

23. A chair as defined in claim 20, wherein said seat portion further comprises a back brace connected to said seat portion along an intermediate fold line, so the back brace can brace against said back portion when the continuous loop of material is in the second, chair position.

24. A chair as defined in claim 23, wherein each of said side portions further comprise a side support portion connected to said side portions along an intermediate fold line, with the side support portion being positioned adjacent to said side portion to strengthen the arm rests formed when the continuous loop of material is in the second, chair position.

25. A chair as defined in claim 24, wherein at least one of said side portions further comprises a seat support portion connected to said side support portion along an intermediate fold line, said seat support portion being positionable adjacent the top of the legs when the loop of material is in the second, chair position.

26. A chair as defined in claim 24, wherein said back portion further comprises a back rest portion connected to the back portion along an intermediate fold line, the second back rest position being positionable on the inside of the continuous loop abating the back brace portion when the continuous loop of material is in the second, chair position.

27. A chair as defined in claim 26, wherein said back rest portion further comprises a tab on an outermost edge of the back rest portion, and wherein one of said seat portion or back rest on said seat portion contains an aperture into which the tab may be removeably inserted to retain the second back rest portion in position when the continuous loop of material is in the second, chair position.

28. A chair as defined in claim 27, wherein said first substantially flat position is substantially square in shape and substantially smaller in two dimensions than is the sheet of material forming the continuous loop.

29. A chair as defined in claim 27, wherein said legs are defined by repositioning every third fold line inside of said continuous loop.

30. A chair as defined in claim 20, wherein each of said side portions further comprise a side support portion connected to said side portions along an intermediate fold line, with the side support portion being positioned adjacent to said side portion to strengthen the arm rests formed when the continuous loop of material is in the second, chair position.

31. A chair as defined in claim 30, wherein at least one of said side portions further comprises a seat support portion connected to said side support portion along an intermediate fold line, said seat support portion being positionable adjacent the top of the legs when the loop of material is in the second, chair position.

32. A chair as defined in claim 30, wherein printed indicia is placed on at least a portion of the exposed surface of said chair.

* * * * *

UNITED STATES PATENT AND TRADEMARK OFFICE

CERTIFICATE OF CORRECTION

PATENT NO. : 4,813,744

DATED : March 21, 1989

INVENTOR(S) : Phillip M. Scalisi and Joseph F. Scalisi

It is certified that error appears in the above-identified patent and that said Letters Patent is hereby corrected as shown below:

Column 4, line 35, change "numbers like parts" to --numbers refer to like parts--.

Column 6, line 2, change "16, 1, 20, 22" to --16, 18, 20, 22--.

Column 9, line 10, change "cut line !46" to --cut line 146--.

Column 9, line 14, change "cut line !46" to --cut line 146--.

Column 9, line 48, change "seat portion !60" to --seat portion 160--.

Column 11, line 4, change "the distance edge 112" to --the distance between the bottom edge 112--.

Column 13, line 12, change "!20 and a back panel !22" to --120 and a back panel 122--.

Column 16, line 1, change "fold between" to --fold line located between--.

Signed and Sealed this

Twenty-eighth Day of November 1989

*Attest:*

JEFFREY M. SAMUELS

*Attesting Officer* *Acting Commissioner of Patents and Trademarks*